US009649754B1

(12) United States Patent
Chalmers

(10) Patent No.: US 9,649,754 B1
(45) Date of Patent: May 16, 2017

(54) PIPE COUPLING TOOL FOR INSERTING AND REMOVING A COUPLING FROM OPPOSITE ENDS OF A PLASTIC PIPE

(71) Applicant: Steven Chalmers, Castle Rock, CO (US)

(72) Inventor: Steven Chalmers, Castle Rock, CO (US)

( * ) Notice: Subject to any disclaimer, the term of this patent is extended or adjusted under 35 U.S.C. 154(b) by 36 days.

(21) Appl. No.: 14/741,322

(22) Filed: Jun. 16, 2015

(51) Int. Cl.
*B25B 27/10* (2006.01)
*B25B 27/02* (2006.01)

(52) U.S. Cl.
CPC ..... *B25B 27/026* (2013.01); *B25B 27/10* (2013.01)

(58) Field of Classification Search
CPC ..... B25B 27/02; B25B 27/026; B25B 27/06; B25B 27/064; B25B 27/10; B25D 1/16
USPC ..... 29/237, 244, 252, 267, 272
See application file for complete search history.

(56) References Cited

U.S. PATENT DOCUMENTS 1,204,028 A * 11/1916 Johnson ..... B25B 27/12 29/222
2,163,716 A * 6/1939 Turner ..... H01R 43/20 29/267
2,719,695 A * 10/1955 Mckee ..... F16L 1/09 254/109
3,299,496 A * 1/1967 Christensen ..... B25B 27/10 29/237
4,266,330 A * 5/1981 Conte ..... B23P 19/04 29/267
6,293,004 B1 * 9/2001 Holliday ..... B25B 27/10 29/751
7,120,997 B2 * 10/2006 Islam ..... B25B 27/10 29/748
8,615,863 B1 * 12/2013 Hope ..... B25B 27/10 29/255
2008/0010799 A1 * 1/2008 Cook ..... F16L 1/09 29/237
2011/0094077 A1 * 4/2011 Siddall ..... B25B 27/02 29/281.1
2012/0124813 A1 * 5/2012 Biedermann ..... A61B 17/7037 29/525.01
2014/0007395 A1 * 1/2014 Hemingway ..... B25B 25/005 29/281.1

* cited by examiner

*Primary Examiner* — Joseph J Hail
*Assistant Examiner* — J Stephen Taylor

(57) ABSTRACT

A pipe coupling tool used for inserting and removing a plastic pipe coupling from one end of a plastic pipe or from opposite ends of a plastic pipe. The tool includes a handle with fork arms. A pair of link arms are attached to the fork arms and to a plunger. The plunger is received inside a plunger cylinder. A cylinder block is mounted on the plunger cylinder. The block includes a first "U" shaped pipe arm and a base plate. The first "U" shaped pipe arm adapted for engaging a first clamp grip when compressing or releasing the pipe coupling in the plastic pipe. A second "U" shaped pipe arm is attached to the plunger and adapted for engaging a second clamp grip when compressing or releasing the pipe coupling in the plastic pipe.

15 Claims, 2 Drawing Sheets

PIPE COUPLING TOOL FOR INSERTING AND REMOVING A COUPLING FROM OPPOSITE ENDS OF A PLASTIC PIPE

This non-provisional patent application claims the benefit and subject matter of a provisional patent application Ser. No. 62/013,446, filed on Jun. 17, 2015, by the subject inventor, and having a title of "Pipe Coupling Tool for Inserting and Removing a Coupling from Opposite Ends of a Plastic Pipe".

BACKGROUND OF THE INVENTION (a) Field of the Invention

This invention relates to a pipe coupling tool for installing and repairing plastic pipe, and more particularly, but not by way of limitation, to a compact, pipe coupling tool used for installing and repairing the plastic pipe by inserting ends of a coupling into opposite ends of the plastic pipe and pressing the coupling into the pipe ends for a secure fit. Also, the tool can be used for removing the coupling from the pipe.

(b) Discussion of Prior Art

Plastic pipe, typically having a ¾ or 1 inch diameter, is commonly used for lawn and garden sprinkler systems, used as water pipe, and used for various landscaping and irrigation projects. Unlike metal pipe, plastic pipe can be easily cut using a shovel, a hoe, a back hoe and other digging tools, thereby requiring a coupling to repair the damaged pipe. Also, plastic couplings, such as a straight coupling, an elbow coupling, and a "T" shaped coupling, with barbed ends, are attached to opposite ends of the pipe when installing a new water pipe system. When inserting the coupling into an end of the plastic pipe, upward to 200 psi is required to insert the coupling for a proper seat inside the pipe. Therefore, a compact and easy to use pipe coupling tool will greatly improve the time and energy required to install or remove a pipe coupling from a plastic pipe.

In U.S. Pat. No. 7,320,165 to Hand, U.S. Pat. No. 4,893,393 to Marshall, U.S. Pat. No. 4,054,989 to Ball et al. and U.S. Pat. No. 3,494,016 to Evans, various plastic pipe coupling tools are disclosed for attaching a pipe coupling to opposite ends of a plastic pipe. None of these prior art coupling tools provide the unique structure, function and advantages of the subject invention disclosed herein.

SUMMARY OF THE INVENTION

In view of the foregoing, it is a primary objective of the subject invention to provide an easy to use, plastic pipe coupling tool, which can be used with various diameter plastic pipe.

Another object of the invention is its compact design for use in close quarters, such as a small hole in a ground surface, and where movement of the tool is limited.

Yet another object of the coupling tool is it can be used with different types of plastic couplings for both installing and removing the coupling from one end or opposite ends of a plastic pipe.

These and other objects of the present invention will become apparent to those familiar with the installation and repair of plastic pipe when reviewing the following detailed description and drawings of the pipe coupling tool, showing novel construction and a combination of structural elements as described herein.

BRIEF DESCRIPTION OF THE DRAWINGS

The accompanying drawings illustrate complete preferred embodiments in the present invention according to the best modes presently devised for the practical application of the plastic pipe coupling tool, and in which.

DETAILED DESCRIPTION OF THE PREFERRED EMBODIMENTS

Figure 1:
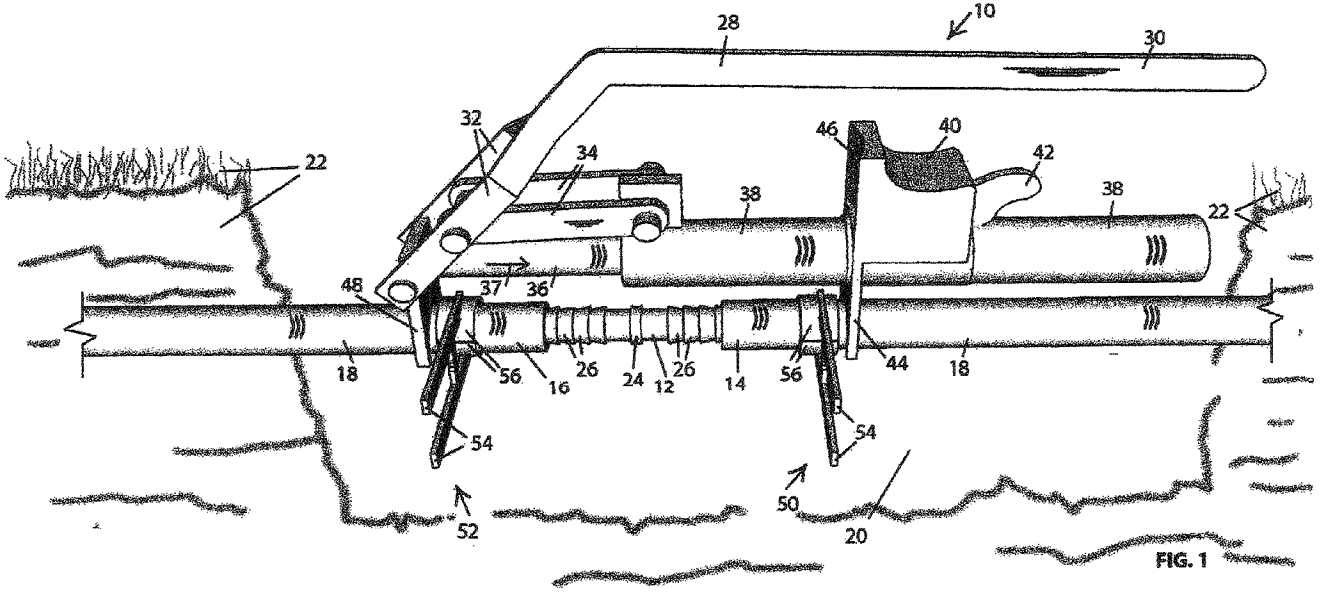
FIG. 1 is a perspective view of the subject pipe coupling tool positioned to insert opposite ends of a pipe coupling inside opposite ends of a plastic pipe.

In FIG. 1, a perspective view of the subject pipe coupling tool is shown, having general reference numeral 10, for inserting a straight, plastic pipe coupling 12 inside one end 14 and an opposite end 16 of a plastic pipe 18. As mentioned above, the coupling tool 10 can be used with different diameter plastic pipe, typically having a diameter of ¾ and 1 inch and different configurations of pipe couplings. In this drawing, the coupling tool 10 is shown engaging the opposite ends 14 and 16 of the plastic pipe 18 in a small hole 20 in a ground surface 22. In this example, the coupling tool 10 is used to repair a buried broken pipe 18 in the ground surface 22.

The coupling 12 is shown with a center stop 24 and spaced apart barbs 26 used to hold the coupling in a tight fit inside the pipe 18. Because of the barbs 26 and the tight fit to prevent possible water leakage, a force upward to 200 psi is often required to insert and remove the coupling 12 from the pipe 18. Obviously, this is why the subject invention is needed for ease in installing and removing the pipe coupling from the plastic pipe.

Figure 3:
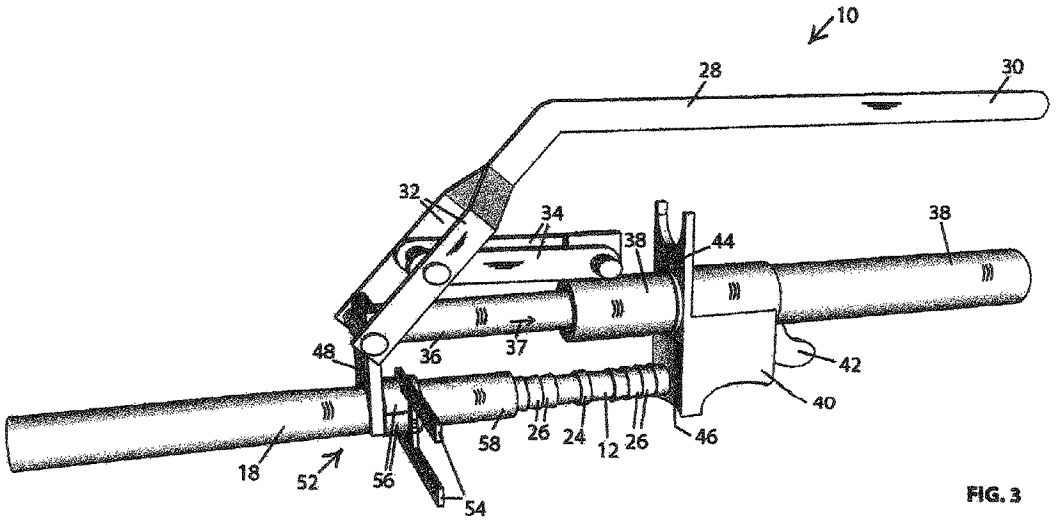
FIG. 3 is a perspective view of the tool positioned to insert one end of the pipe coupling in one end of the plastic pipe.
Figure 4:
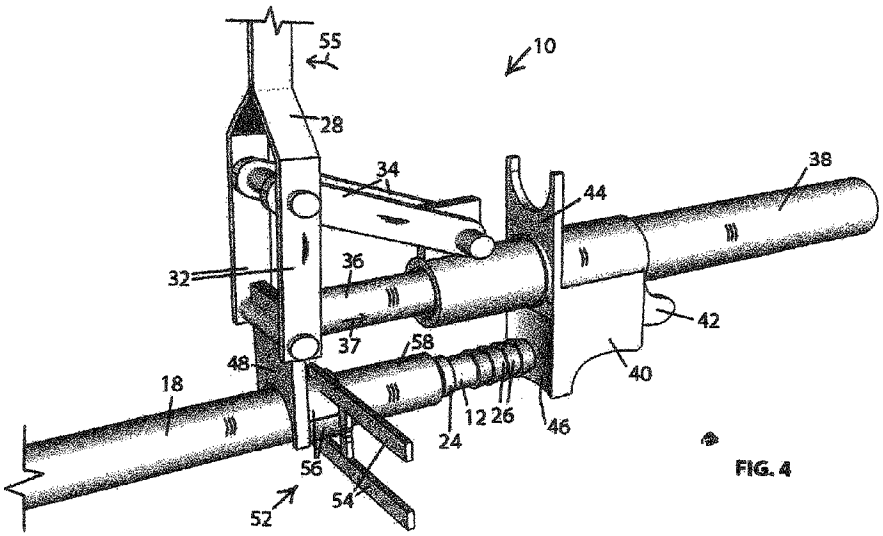
FIG. 4 is another perspective view of the tool having completed the compression of the pipe inside the one end of the plastic pipe.

The plastic pipe coupling tool 10 includes a handle 28 with a handle grip 30 and a pair of handle fork arms 32. The fork arms 32 are pinned to one end of a pair of horizontal link arms 34. The fork arms 32 are also pinned to one end of a plunger 36. An opposite end of the plunger 36 is slidably received, as indicated by arrow 37, inside a plunger cylinder 38. A cylinder block 40 is slidably mounted around the plunger cylinder 38. The block 40 includes a lock 42 for securing it on the cylinder 38. The block 40 also includes a downwardly extending, first "U" shaped pipe arm 44 for receipt around a portion of the pipe 18, and a base plate 46 used to engage one end of a portion of the coupling 12, as shown in FIGS. 3 and 4. The tool 10 also includes a second, inverted "U" shaped pipe arm 48 attached to the end of the plunger 36 and for receipt around a portion of the pipe 18.

The pipe coupling tool 10 is used in conjunction with a first pipe clamp, having general reference numeral 50, and a second pipe clamp, having a general reference numeral 52. The pipe clamps 50 and 52 include clamp arms 54 attached to semi-circular clamp grips 56 for receipt around a portion of the pipe 18 and holding the pipe in place during the operation of the pipe coupling tool 10. While the pipe clamps 50 and 52 are shown in the drawings, it should kept in mind various types of hand held clamps, vice-grips, pliers and the like can be used for securing the pipe 18.

Figure 2:
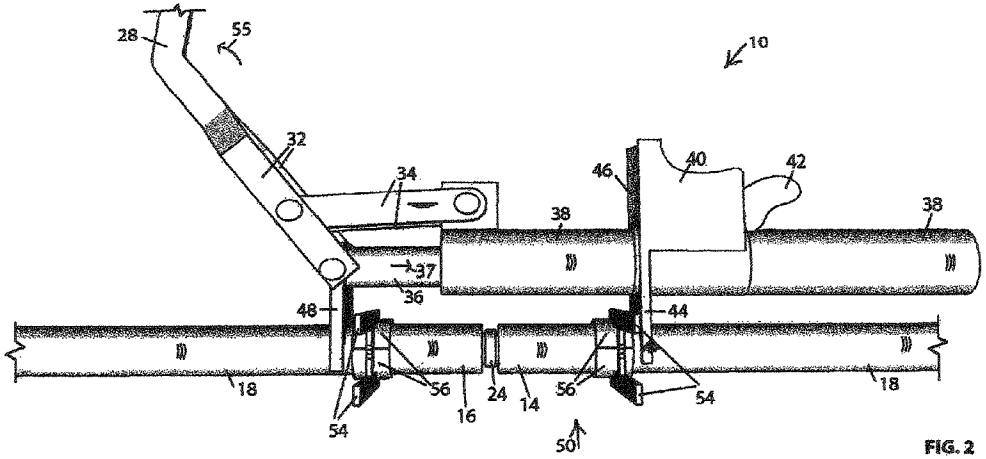
FIG. 2 is another perspective view of the tool having completed the compression of the pipe coupling inside the ends of the plastic pipe.

In FIG. 2, the handle 28 has been raised and rotated counterclockwise, as indicated by arrow 55. At this time, the handle 28 moves the link arms 34 and the plunger 36 linearly to the right, with the plunger received inside the plunger cylinder 38. Also, the lock 42 is used to hold the cylinder block 40 in place with the first pipe arm 44 disposed next to the clamp grips 56 of the first pipe clamp 50.

As the handle 28 continues to rotate upwardly, the first pipe arm 44 holds the first pipe clamp 50 in place as the second pipe arm 48 engages the clamp grips 56 of the second pipe clamp 52. At this time, the opposite end 16 of the pipe 18 is moved toward the coupling stop 24. Then, the movement to the right continues as the rest of the coupling 12 is set inside the one end 14 of the pipe 18, thus completely inserting the coupling inside the opposite ends of the pipe. The coupling tool 10 and the pipe clamps 50 and 52 are now removed from the pipe 18. Also, at this time, metal clamps are attached to the pipe 18 next to the coupling 12 to prevent water pressure from disengaging the coupling from the pipe during the pipe's operation. The metal clamps are not shown in the drawings and are not part of the subject invention.

When removing the coupling 12 from the plastic pipe 18, the handle 28 would first be raised and the first and second pipe arms 44 and 48 placed on the opposite sides of the clamp grips 56. As the handle 28 is lowered in a clockwise direction, the combination of the movement of the pipe arms 44 and 48, moving away from each other, will release the coupling 12 from the pipe 18.

In FIG. 3, another perspective view of the coupling tool 10 is shown for installing the pipe coupling 12 in a single end 58 of the plastic pipe 18. In this example, the cylinder block 40 has been rotated 180 degrees on the plunger cylinder 38, with the base plate 46 disposed next to one end of the coupling 12. Also, the second pipe clamp 52 is shown with the clamp grips 56 engaging the single end 58 of the pipe 18.

In FIG. 4, the handle 28 has been raised, as indicated by arrow 55, and the second pipe arm 48 has engaged the clamp grips 56. As the handle continues to move upwardly, the single end 58 of the pipe 18 moves to the right until it engages the stop 24 of the coupling 12, thus completing the installation of the coupling in the single end 58 of the pipe 18.

When removing the coupling 12 from the plastic pipe 18, as shown in FIG. 4, the handle would first be raised and the second pipe arm 48 placed on the opposite side of the clamp grip 56. Also, another clamp grip 56 would be attached to the exposed end of the coupling 12 and the first pipe arm 44 places next to the clamp grip. As the handle 28 is lowered in a clockwise direction, the combination of the movement of the pipe arms 44 and 48, moving away from each other, would release the coupling 12 from the end of the plastic pipe 18.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which an exclusive privilege and property right is claimed are defined as follows:

1. A pipe coupling tool for inserting and removing a plastic pipe coupling from one end of a plastic pipe or from opposite ends of a plastic pipe, the one end of the plastic pipe having a first clamp grip attached thereto, the opposite end of the plastic pipe having a second clamp grip attached thereto, the pipe coupling tool comprising:

a handle;

a plunger, one end of the plunger attached to the handle;

a plunger cylinder, the plunger slidably received inside the plunger cylinder;

a cylinder block rotatably mounted on the plunger cylinder, a portion of the cylinder block adapted for engaging the first clamp grip when compressing or releasing the pipe coupling in the plastic pipe;

the cylinder block having a base plate, the base plate, when rotated on the cylinder block, adapted for compressing the pipe coupling in the one end of the plastic pipe: and a portion of the plunger adapted for engaging the second clamp grip when compressing or releasing the pipe coupling in the plastic pipe.

2. The tool as described in claim 1 wherein the handle includes fork arms, the fork arms attached to one end of a pair of link arms, an opposite end of the link arms attached to the plunger.

3. The tool as described in claim 2 wherein the cylinder block includes a first "U" shaped pipe arm, the first "U" shaped pipe arm adapted for engaging the first clamp arm.

4. The tool as described in claim 3 wherein the plunger cylinder includes a second "U" shaped pipe arm attached thereto, the second "U" shaped pipe arm adapted for engaging the second clamp grip.

5. The tool as described in claim 3 wherein the first "U" shaped pipe arm extends outwardly from one side of the cylinder block and the base plate extends outwardly from an opposite side of the cylinder block.

6. The tool as described in claim 1 wherein the cylinder block includes a lock for securing the block in place along a length of the plunger cylinder.

7. A pipe coupling tool for inserting and removing a plastic pipe coupling from one end of a plastic pipe or from opposite ends of a plastic pipe, the one end of the plastic pipe having a first clamp grip attached thereto, the opposite end of the plastic pipe having a second clamp grip attached thereto, the pipe coupling tool comprising:

a handle with fork arms in one end thereof;

a pair of link arms, one end of the link arms attached to the fork arms, an opposite end of the link arms attached to a plunger;

a plunger cylinder, the plunger slidably received inside the plunger cylinder;

a cylinder block rotatably mounted on the plunger cylinder, the block having a first "U" shaped pipe arm, the first "U" shaped pipe arm adapted for engaging the first clamp grip when compressing or releasing the pipe coupling in the plastic pipe;

the cylinder block having a base plate, the base plate when rotated on the plunger cylinder adapted for compressing the pipe coupling in the plastic pipe; and a second "U" shaped pipe arm attached to the plunger cylinder, the second "U" shaped pipe arm adapted for engaging the clamp grip when compressing or releasing the second pipe coupling in the plastic pipe.

8. The tool as described in claim 7 wherein the cylinder block includes a lock for securing the block in place along a length of the plunger cylinder.

9. The tool as described in claim 7 wherein the first "U" shaped pipe arm extends outwardly from one side of the cylinder block and the base plate extends outwardly from an opposite side of the cylinder block.

10. A pipe coupling tool for inserting a plastic pipe coupling in one end of a plastic pipe and for inserting and removing the plastic pipe coupling from opposite ends of the plastic pipe, one end of the plastic pipe having a first clamp grip attached thereto, the opposite end of the plastic pipe having a second clamp grip attached thereto, the pipe coupling tool comprising:

a handle;

a plunger, one end of the plunger attached to the handle;

a plunger cylinder, the plunger slidably received inside the plunger cylinder;

a cylinder block rotatably mounted on the plunger cylinder, a portion of the cylinder block adapted for engaging an end of the pipe coupling when compressing or releasing the pipe coupling in the plastic pipe;

the cylinder block having a base plate, the base plate when rotated on the plunger cylinder adapted for compressing the pipe coupling in the plastic pipe; and a portion of the plunger adapted for engaging the first clamp grip when compressing or releasing the pipe coupling in the plastic pipe.

11. The tool as described in claim 10 wherein the handle includes fork arms, the fork arms attached to one end of a pair of link arms, an opposite end of the link arms attached to the plunger.

12. The tool as described in claim 10 wherein a first "U" shaped pipe arm extends outwardly from one side of the cylinder block and the base plate extends outwardly from an opposite side of the cylinder block.

13. The tool as described in claim 10 wherein the cylinder block includes a first "U" shaped pipe arm, the first "U" shaped pipe arm adapted for engaging the first clamp arm.

14. The tool as described in claim 10 wherein the plunger includes a second "U" shaped pipe arm attached thereto, the second "U" shaped pipe arm adapted for engaging the second clamp grip.

15. The tool as described in claim 10 wherein the cylinder block includes a lock for securing the block in place along a length of the plunger cylinder.

* * * * *